US005992722A

United States Patent [19]

Strick et al.

[11] Patent Number: 5,992,722

[45] Date of Patent: Nov. 30, 1999

[54] ZERO FORCE ROLL RELEASE FOR HIGH SPEED PRESS FEED UNITS

[75] Inventors: Leo Strick; Bill Freeman, both of Beaufort, S.C.

[73] Assignee: The Minster Machine Company, Minster, Ohio

[21] Appl. No.: 08/756,790

[22] Filed: Nov. 26, 1996

[51] Int. Cl.[6] ..... B65H 20/00

[52] U.S. Cl. ..... 226/152; 226/154; 226/186

[58] Field of Search ..... 226/152, 154, 226/181, 186, 187

[56] References Cited

U.S. PATENT DOCUMENTS

| | | | |
|---|---|---|---|
| 3,964,739 | 6/1976 | Garcia | 226/187 |
| 4,488,688 | 12/1984 | Trubitsin et al. | 226/187 |
| 4,846,388 | 7/1989 | Benbow | 226/187 |
| 5,000,439 | 3/1991 | Yoshizawa | 226/187 |
| 5,129,749 | 7/1992 | Sato | 226/187 |
| 5,150,022 | 9/1992 | Waddington | 318/563 |
| 5,197,645 | 3/1993 | Nordlof | 226/154 |
| 5,372,321 | 12/1994 | Ohkubo et al. | 226/187 |
| 5,420,678 | 5/1995 | Rasch et al. | 226/187 |

FOREIGN PATENT DOCUMENTS

| | | |
|---|---|---|
| 1359197 | 7/1974 | United Kingdom . |
| 1507984 | 4/1978 | United Kingdom . |
| 1593364 | 7/1981 | United Kingdom . |

*Primary Examiner*—Tamara L. Graysay
*Assistant Examiner*—Matthew A. Kaness
*Attorney, Agent, or Firm*—Randall J. Knuth

[57] ABSTRACT

An apparatus for intermittently feeding a workpiece to a press, the device including a feed roll with a pinch roll opposite the feed roll, so that a workpiece may pass between the rolls. A servo screw, pinch roll actuator is connected to the pinch roll so that during apparatus operation, changes in pinch roll pressure may be developed between the pinch roll and the workpiece without causing loss of contact between the pinch roll and the workpiece. A new belt drive system and method of pinch roll control is also disclosed.

21 Claims, 1 Drawing Sheet

ZERO FORCE ROLL RELEASE FOR HIGH SPEED PRESS FEED UNITS

BACKGROUND OF THE INVENTION

1. Field of the Invention

The present invention relates to an apparatus for feeding stock material intermittently to a press, such as those used for stamping or drawing.

2. Description of the Related Art

There are numerous types of press feed mechanisms available, each exhibiting a set of strength and weaknesses depending upon the specific application. For instance, a cam-feed type mechanism having high performance characteristics means usually foregoing flexibility such as with a servo-type machine. A servo-type press feed mechanism has an increased ease of set-up, but may sacrifice speed as offered by a cam-feed mechanism.

New high speed electronic roll feed mechanisms provide both smooth velocity profiles and high speed characteristics with flexibility. Prior cam, servo, and high speed electronic feed devices utilize different arrangements for providing the ability to provide clean and accurate lifting of the pinch roll. The pinch roll moves from a maximum clamping and contacting position against the stock, to a position away and out of contact with the stock material, thus creating what is termed roll lift. This roll lift requirement, if not accurate, and in time with roller release can prohibit proper die pilot pin operation. Furthermore, these devices need to permit accurate pinch roll return to a contact position with the material in a controlled manner. Slamming of the pinch or pressure roll into the material can cause the roll to bounce or, alternatively, deform the material.

Typical press feed mechanisms have utilized roll lift in which the feed has a pinch roll that moves out of contact with the stock so that the press can control stock by the use of pilot pins and align the stock within the press. In other words, the pinch roll loses physical contact with the stock for a particular time during the feeding cycle. This prior system was utilized to eliminate any placement error that was left over from the feed progression.

Known feed system also includes a gear train that increases the rotational inertia of the system.

What is needed in the art is the ability to more accurately control the stocks at high speed by using a higher speed roll lift method.

SUMMARY OF THE INVENTION

According to the present invention, a material press feed mechanism is disclosed. The pinch roll of the present invention is controlled so that the pinch roll, during apparatus operation, does not lose contact with the workpiece or stock during such operation, i.e. the pinch force measured between the pinch roll and stock goes to substantially zero thereby reducing the friction therebetween. In such a situation, the pilot pins of the associated stamping or drawing press easily control movement of the stock or workpiece.

Zero force as defined in this patent application is that in which the clamping force between the pinch roll and stock in the clamping direction goes to substantially zero. At this condition, the press will be able to control the stock.

An advantage of the present invention is that roll lift is substantially eliminated between the pinch roll and the stock, therefore the press feed mechanism has a much faster response time in corresponding cycles.

A further advantage of the invention is the use of a pinch roll actuator to force the pinch roll toward and away from the stock without substantial movement. During press feed operation, there is no necessity for creating roll lift since the pinch roll actuator only changes the pinch force between the pinch roll and the stock. In other words, the pinch force is reduced to substantially zero without permitting loss of contact between the pinch roll and stock.

Another advantage of the present invention is that pinch roll movement is controlled so that there is substantially zero movement at clamp time. A faster response time results since, in going from zero clamp force to maximum clamp force, substantially no movement of the pinch roller occurs other than with possible compression of the stock. With a faster response time, corresponding increases in output speed are possible.

Another advantage of the present invention is that by use of the zero force method described above, no marking of the stock is made, as with conventional roll lift mechanisms. Because there is no gap created after the pinch roll pressure is released, there is no opportunity for the pinch roll to slam closed (Roll Lift Bounce) or into contact on the stock on application of maximum clamping force. No impact damage to the roll or stock is therefore created.

A further advantage of the present invention is that reduced vibration or roll bounce is created when maximum clamping forces are applied. In the prior art, when the pinch roll would close, vibration would be created. The new system of the present invention eliminates any such error that could be produced in the feed progression through the reduction of such roll lift bounce. Reduction of vibration increases the accuracy of the feed progression, in addition to allowing an increase in the time available for the feed progression.

Yet another advantage of the present invention is the use of a unique belt drive system to rotate both the feed and pinch roll. By use of a double sided timing belt, an elimination of conventional gear train members is possible.

A further advantage of the present invention is the use of a force based servo screw actuator. Such actuator permits greater control and faster pinch roll response as compared to prior pneumatic or hydraulic actuators.

Another advantage of the present invention is the use of a back up roll support on the feed roll of the device. Such back up roll increases the placement accuracy and controllability of the feed roll, by reducing the deflection of the feed roll shaft.

The invention, in one form thereof, comprises an apparatus for intermittently feeding a workpiece to a press. The apparatus includes a feed roll with a pinch roll opposite the feed roll with a workpiece passing between the rolls. A drive mechanism used to drive the feed roll. A pinch roll actuator is connected to the pinch roll so that during apparatus operation the actuator changes pinch roll pressure developed between the pinch roll and the workpiece without causing loss of contact between the pinch roll and the workpiece.

The invention, in another form thereof, comprises an apparatus for intermittently feeding a workpiece to a press. The apparatus includes a feed roll with a pinch roll opposite the feed roll with a workpiece passing between the rolls. A drive mechanism to used drive the feed roll. A pinch roll actuator is connected to the pinch roll so that during apparatus operation the pinch roll pressure developed against the workpiece from a maximum clamp force to one of zero force.

The invention, in yet another form thereof, includes a method of controlling a pinch roll in a press feed unit having a feed roll, the method comprising the steps of supplying a workpiece between the pinch roll and feed roll; applying force to the pinch roll to create a maximum pinch force between the pinch roll and workpiece for workpiece movement by the feed roll; and releasing the force previously created while keeping the pinch roll in contact with the workpiece for workpiece movement by the press.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
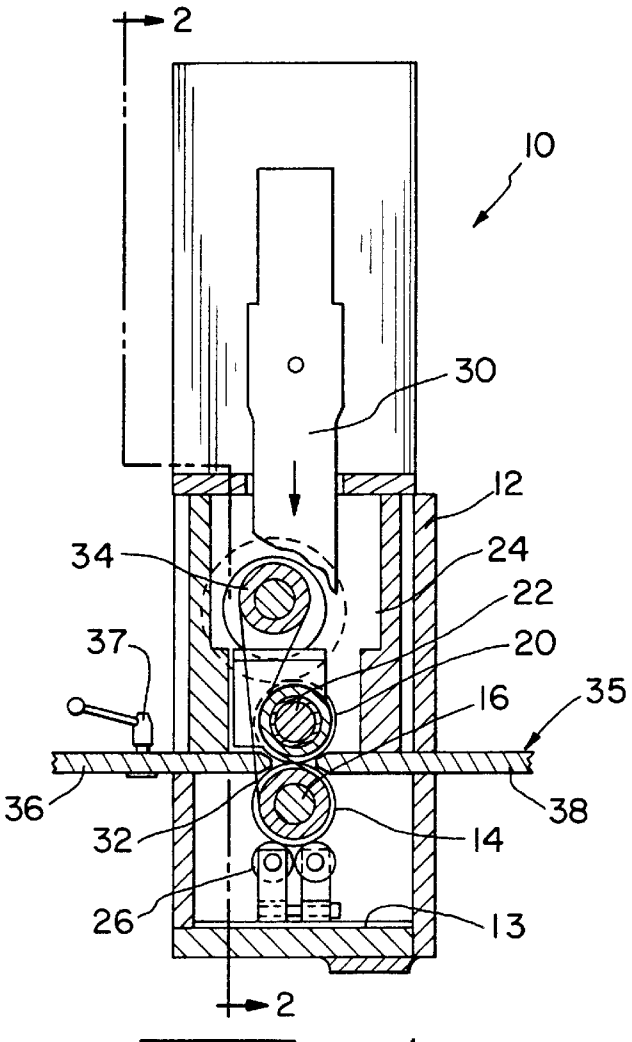
FIG. 1 is a sectional view of the present invention.

Referring now to the drawings and particularly to FIG. 1, there is shown an apparatus, generally designated by the numeral 10, for feeding a workpiece, such as a continuous stock material from an uncoiling apparatus, to a power operated press to perform one of a variety of press operations such as, but not limited to, stamping, punching, cutting, staking, or the like. Apparatus 10 includes a housing 12 for supporting the rest of the device.

Within housing 12 is a feed roll 14 attached to feed roll shaft 16. A servo motor 18 (FIG. 2) is the roll drive mechanism for apparatus 10. Parallel and opposite to feed roll 14 is a pinch roll 20. Pinch roll 20 is located upon a pinch roll shaft 22. Pinch shaft roll 22 is disposed within a pinch roll bracket 24 which contains both pinch roll 20 and pinch roll shaft 22 for rotation therein.

Figure 2:
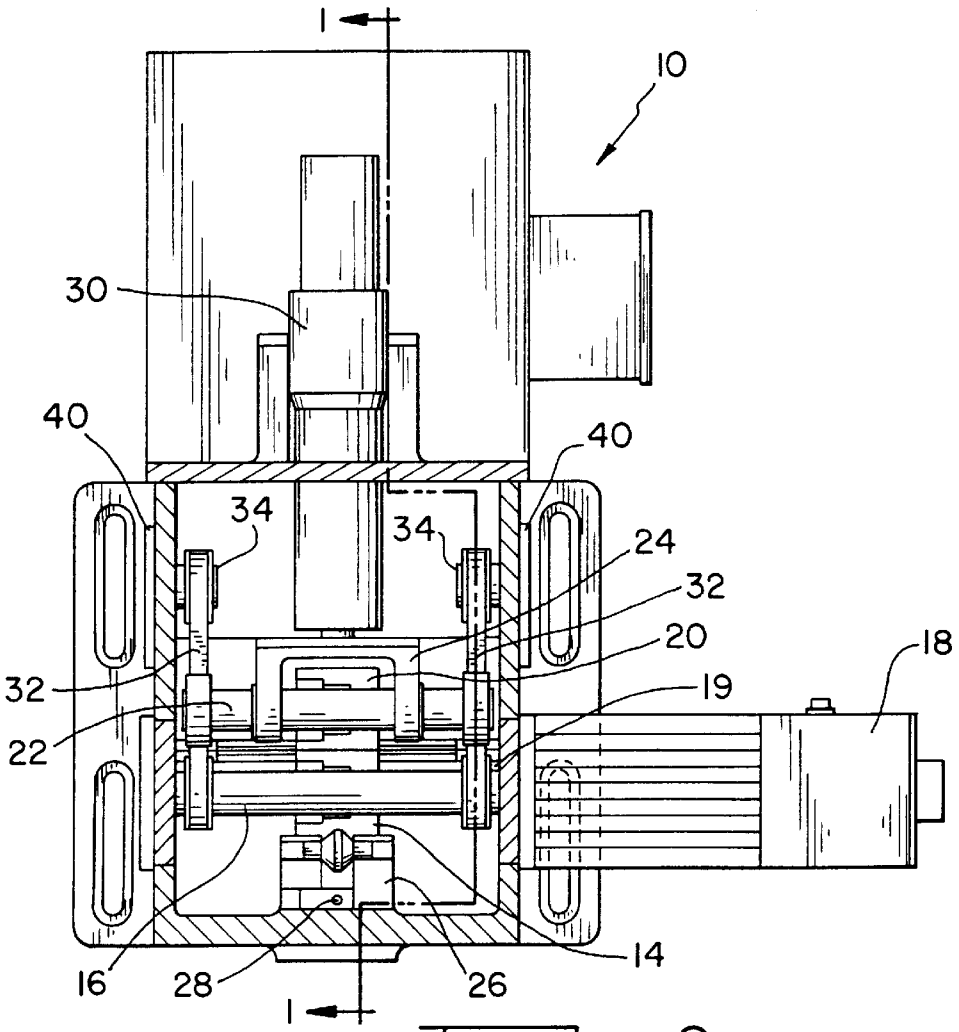
FIG. 2 is a sectional view of the device of FIG. 1 taken along the line 2—2 and viewed in the direction of the arrows.

Feed roll 14 is attached to servo motor 18 via keyless bushings 19 (FIG. 2). This arrangement results in a substantial rotational inertia savings due to the elimination of a coupling between servo motor 18 (FIG. 2) to feed roll 14 (FIG. 1). In this embodiment the servo motor shaft is actually feed roll shaft 16. As shown in FIGS. 1 and 2, behind feed roll 14 are optional back up rolls 26 that increase the stability of feed roll 14. Back up rolls 26 are keyed for sliding along bottom 13 of housing 12. A rotatable bolt 28 passes through each of the mountings for back up rolls 26, thereby permitting adjustment and control of feed roll 14. These back up rolls 26 assist in rotatable supporting feed roll 14.

Pinch roll bracket 24 is steel machined and acts as a pinch roll support. Additionally, pinch roll bracket 24 is keyed for movement toward and away, in a direction normal, to the workpiece and stock table 35.

As shown in FIG. 1, a servo pinch roll actuator 30 is connected to move and control pinch roll bracket 24 toward and away from feed roll 14. Additionally, and more importantly for the present invention, actuator 30 creates and controls the clamping force of pinch roll 20 to the workpiece. In operation, servo pinch roll actuator will only vary the clamping force between pinch roll 20 and the workpiece, not lift pinch roll 20 from the workpiece. Servo pinch roll screw actuator 30 operates on electric current, such that the force created and applied to pinch roll 20 and therefore the workpiece, is proportional to the applied electric current. This actuator 30 is not a position based device but force based in that it's position is dependent on the electric current supplied to it along with any forces (gravity, etc.) or opposing forces (stock support or interference, etc.).

Transmission of rotation is caused by a timing belt 32, which belt extends from an idler pulley 34 on pinch roll bracket 24, about feed roll 16, behind pinch roll shaft 22 and up again to pulley 24. Timing belts 32 are double sided, double toothed belts able to transmit rotation from the drive means (servo motor 18) to the rolls 14 and 20.

As shown in FIG. 2, two such timing belts 32 are utilized on each side of apparatus 10. The stock inlet table 36 (one part of stock table 35) along with stock guide 37 is utilized for guiding workpieces to device 10. The stock outlet table 38 (a second part of stock table 35) guides product workpieces toward an associated press (not shown). As shown in FIG. 2 at least two eccentric style belt tensioners 40 are used about either pulley 34 for tensioning timing belt 32.

A mechanical or electronic control mechanism, in connection to the press (not shown), correctly operates motor 18 and servo pinch roll actuator 30 in time with press operation. An adjustment mechanism is connected to the control mechanism to correctly control the electric current applied to actuator 30.

In operation, the present invention causes pinch roll 20 not to separate from any workpiece moving through device 10 when the clamping force is released. Workpiece material slides through stock inlet table through stock guides 37 and into contact with feed roll 14 and pinch roll 20. Servo motor 18 drives feed roll 14 in incremental steps as necessary for the feeding of material to a press (not shown) during feed progression. To insure proper alignment of feed material passing through device 10 and along stock output table 38, the pinch force between pinch roll 20 and the workpiece, or alternatively the force between pinch roll 20 and feed roll 14, will be reduced substantially to zero by a reduction in force created by pinch roll actuator 30 of FIG. 1. Actuator 30 causes a reduction of the maximum clamping force between pinch roll 20 and the workpiece, thereby permitting the workpiece passing along the stock output table 38 to be moved, slided, or guided, by the pilot pins within the press tooling (not shown).

On another or subsequent duty cycle, when more material needs to be fed to the press, actuator 30 will cause pinch feed roll 20, to change from its substantially zero force clamping state to that of a maximum clamping force created between pinch roll 20 and the workpiece. It is at this time that maximum current will be applied to servo motor 18 and the workpiece will be acted upon and slid in a direction from stock inlet table 36 towards stock output table 38. After this part of the cycle has been completed, actuator 30 will again reduce the clamp forced to substantially zero, between pinch roll 20 and the workpiece.

Although the clamping force created by actuator 30 varies from a maximum clamping force to that of zero force (as defined in this application), the current applied to actuator 30 may not necessarily need to go to zero. It may be necessary, or in some embodiments desirable, to cause a very small drag to occur between pinch roll 20 and the workpiece. Even in this case, pinch roll will not be elevated or lifted away from the workpiece by actuator 30.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for intermittently feeding a metallic workpiece to a press, the apparatus comprising:

a feed roll;

a pinch roll opposite said feed roll permitting the metallic workpiece to pass between said rolls;

a drive mechanism to drive said feed roll; and a pinch roll actuator connected to said pinch roll such that said pinch roll is biasable to the metallic workpiece passing between said rolls, said pinch roll actuator selectively reciprocatable towards and away from said pinch roll that during apparatus operation said pinch roll actuator changes pitch roll pressure developed between said pinch roll and the metallic workpiece without loss of contact between said pinch roll and the metallic workpiece.

2. The apparatus of claim 1 in which said pinch roll actuator controls pinch roll pressure from a maximum clamp force to that of zero force.

3. The apparatus of claim 1 in which said pinch roll actuator controls the pinch roll pressure in proportion to electrical current applied to said actuator.

4. The apparatus of claim 1 in which drive mechanism comprises an electric motor attached by keyless bushings to said feed roll.

5. The apparatus of claim 1 in which said drive mechanism comprises belt drive mechanism including a timing belt connected to said feed roll and an electric motor attached by keyless bushings to said feed roll.

6. The apparatus of claim 1 further comprising a backup roll to rotatably support said feed roll.

7. The apparatus of claim 1 wherein the apparatus is located adjacent a press.

8. An apparatus for intermittently feeding a workpiece to a press, the apparatus comprising:

a feed roll;

a pinch roll opposite said feed roll, permitting the workpiece pass between said rolls;

a drive mechanism to drive said feed roll; and a pinch roll actuator connected to said pinch roll that during apparatus operation selectively changes the pinch roll pressure developed against the workpiece from a maximum clamp force to one of zero force.

9. The apparatus of claim 8 in which said pinch roll actuator controls the pinch roll pressure in proportion to electrical current applied to said actuator.

10. The apparatus of claim 8 in which said drive mechanism comprises an electric motor attached by keyless bushings to said feed roll.

11. The apparatus of claim 8 wherein the apparatus is located adjacent a press.

12. An apparatus for intermittently feeding a workpiece to a press, the apparatus comprising:

a feed roll;

a pinch roll opposite said feed roll permitting, the workpiece pass between said rolls;

a drive mechanism to drive said feed roll; and a servo screw, pinch roll actuator connected to said pinch roll that during apparatus operation selectively changes pinch roll pressure developed between the pinch roll and the workpiece.

13. The apparatus of claim 12 in pinch roll actuator is a force based actuator as opposed to a position based actuator.

14. The apparatus of claim 12 wherein the apparatus is connected to a press.

15. A method of controlling a pinch roll in a press feed unit having a feed roll, the method comprising the steps of:

supplying a metallic workpiece between said pinch roll and said feed roll;

applying force selectively to said pinch roll to create a maximum pinch force between said pinch roll and metallic workpiece for metallic workpiece movement by said feed roll; and releasing the force previously created while keeping said pinch roll in contact with the workpiece for workpiece movement by the press.

16. An apparatus for intermittently feeding a workpiece to a press, the apparatus comprising:

a feed roll;

a pinch roll opposite said feed roll permitting, the workpiece pass between said rolls;

a belt drive mechanism to drive said feed roll; and a pinch roll actuator connected to said pinch roll that during apparatus operation selectively changes pinch roll pressure developed between the pinch roll and the workpiece.

17. The apparatus of claim 16 in which said belt drive mechanism includes a double-sided, double toothed timing belt drivingly connected to both said feed roll and said pinch roll.

18. The apparatus of claim 16 in which said pinch roll actuator controls the pinch roll pressure in proportion to electrical current applied to said actuator.

19. The apparatus of claim 16 wherein the apparatus is connected to a press.

20. An apparatus for intermittently feeding a workpiece to a press, the apparatus comprising:

a feed roll;

a pinch roll opposite said feed roll permitting, the workpiece pass between said rolls;

a drive mechanism to drive said feed roll;

a pinch roll actuator connected to said pinch roll that during apparatus operation selectively changes pinch roll pressure developed between the pinch roll and the workpiece; and at least one back up roll in contact with said feed roll to rotatably support said feed roll.

21. The apparatus of claim 20 wherein the apparatus is located adjacent a press.

* * * * *